US006813896B1

(12) United States Patent
Janke et al.

(10) Patent No.: US 6,813,896 B1
(45) Date of Patent: Nov. 9, 2004

(54) POWER BUS FOR REMOVABLE REFRIGERATOR SHELVES

(75) Inventors: Donald E. Janke, Benton Harbor, MI (US); Steven J. Kuehl, Stevensville, MI (US); Michele E. Emig, St. Joseph, MI (US); Wendeline Rodriguez, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/629,965

(22) Filed: Jul. 30, 2003

(51) Int. Cl.[7] ..... F25B 49/00
(52) U.S. Cl. ..... 62/126; 62/129
(58) Field of Search ..... 62/126, 129, 123; 439/377, 577; 312/408, 116, 223.6

(56) References Cited

U.S. PATENT DOCUMENTS 3,573,430 A * 4/1971 Eisler ..... 219/385
3,608,627 A * 9/1971 Shevlin ..... 165/206
3,636,547 A * 1/1972 Brace et al. ..... 200/85 R
3,998,069 A * 12/1976 Kronenberger et al. ..... 62/288
4,671,074 A * 6/1987 Gostelow et al. ..... 62/186
4,776,182 A * 10/1988 Gidseg ..... 62/448
5,249,973 A * 10/1993 Fujita et al. ..... 439/76.2
5,403,997 A * 4/1995 Wimpee et al. ..... 219/386
5,913,926 A * 6/1999 Anderson et al. ..... 714/6
6,034,445 A * 3/2000 Hewitt ..... 307/80
6,065,821 A * 5/2000 Anderson et al. ..... 312/408
6,082,131 A * 7/2000 Hirosawa et al. ..... 62/448
6,401,399 B1 * 6/2002 Roche et al. ..... 49/501

FOREIGN PATENT DOCUMENTS

EP 0157461 A2 * 10/1985
EP 0558305 A2 * 9/1993
WO WO 92/09061 * 5/1992

* cited by examiner

*Primary Examiner*—William E. Tapolcai
*Assistant Examiner*—Mohammad M. Ali
(74) *Attorney, Agent, or Firm*—Stephen Krefman; Robert O. Rice; John F. Colligan

(57) ABSTRACT

A power bus, connected to a 24V isolated power supply, is provided in a refrigerator where removable shelves can be selectively connected to it. Each shelf has a user interface and a circuit to control a microenvironment within the refrigerator, partially bounded by the shelf. Data between the shelf and a control circuit in the refrigerator can be transmitted over the power bus, or by other methods.

26 Claims, 16 Drawing Sheets

POWER BUS FOR REMOVABLE REFRIGERATOR SHELVES

BACKGROUND OF THE INVENTION

1. Field of the Invention

The invention relates to refrigerators, and more particularly, to a system for delivering power to and transferring data to and from removable shelves in a refrigerator compartment.

2. Description of the Related Art

As used herein, the term "refrigerator" denotes a cabinet that has an internal temperature lower than ambient, and includes what are commonly termed refrigerators and freezers, as well as combinations thereof.

Current refrigerators sometimes have more than one compartment, each having a different environmental parameter such as temperature. Thus, for example, a refrigerator may have a refrigeration compartment where temperature is maintained above 0° C. and a freezer compartment where temperature is maintained below 0° C. Control of the temperature in the refrigerator is generally provided from a single control circuit, with a single set of controls that are adjustable to a user. In some cases, a freezer compartment and a refrigeration compartment may have separate controls for each.

It is known that different foods are best preserved at different temperatures. For example, in refrigeration, colder temperatures are better for preserving meats, and less cold temperatures are better for preserving fruits and vegetables. Similarly, in a freezer compartment, colder temperatures are sometimes better for preserving certain foods than others. To accommodate these different needs, refrigerators are known to have drawers or spaces where slightly different temperatures or humidity levels can be achieved. For example, the refrigeration compartment may have separate drawers for vegetables and meat, each of which has slide controls to allow air circulation at selectable rates to permit slight adjustment of temperature or humidity levels within the drawers. U.S. Pat. No. 4,638,644 discloses removable, sealable shelves that enable a user to adjust the size and location of a compartment within a refrigerator. However, the temperature within the compartment so defined can only be controlled by manually adjusting baffles affecting the air flow within the refrigerator.

One problem with current systems is that there is a limit to the available temperature gradient between compartments. Refrigeration controls control the overall temperature of the refrigerator. Consequently the temperature of individual compartments within the refrigerator is necessarily tied to the overall temperature. The differences can only be accomplished by altering general airflow between compartments. Yet a higher temperature gradient may be desirable to best preserve certain foods.

Another problem is that the location of compartments often determines the available temperature range within the compartment. Generally, colder temperatures pertain at lower locations within a refrigerator. Thus a colder temperature at a higher location within a compartment may be unattainable with present systems.

Another problem is that controls are not always conveniently located. They may be blocked by items in the refrigerator, or located in a compartment remote from the space the user desires to control.

SUMMARY OF THE INVENTION

These and other problems are solved by the present invention where power is delivered to a removable shelf within a refrigerator compartment. More particularly, the refrigerator comprises one or more compartments and is selectively enclosable by a door. It also contains one or more removable shelves and means for mounting each removable shelf within the compartment. In accord with the invention, a power bus is disposed within the compartment, electrically connected to a power source, and a connector is disposed on the removable shelf. Thus, when the removable shelf is mounted within the compartment by the mounting means, the connecter is connected to the power bus to deliver power to the removable shelf. Preferably, the power bus comprises a ground conductor and a power conductor.

In one aspect of the invention, the refrigerator has a control circuit for controlling at least one atmospheric parameter within the compartment. A shelf portion of the control circuit is mounted to the removable shelf, and a main portion of the control circuit is disposed remotely of the removable shelf. The shelf circuit portion is powered by way of the power bus when the removable shelf is mounted within the compartment by the mounting means. Preferably, the parameter controlled by the control circuit is temperature, and the shelf circuit portion has a user interface for adjusting the temperature from the removable shelf. Thus, actuation of the user interface generates a data signal in the shelf circuit portion and the data signal is transmitted to the main circuit portion. The data signal is transmitted to the main circuit portion by way of the power bus, or by way of induction, or by way of at least one data line.

Ideally, the power source is an isolated power supply in the main circuit portion, preferably at 24 volts. The main circuit portion can have a constant current source and a voltage comparator coupled to a refrigerator control. Also, the constant current source can comprise a transistor. Preferably, the constant current source and the voltage comparator are connected to the refrigerator control by at least one opto-isolator.

In one embodiment, the shelf circuit portion comprises a first user interface circuit having a first switch, at least one LED and a first resistor, the first switch and the at least one LED being connected in series and the first resistor and the at least one LED being connected in parallel. In a first mode, the first switch is actuated and the at least one LED is lit, indicating a first user setting. Another aspect of this embodiment comprises a second user interface circuit having a second switch, at least one second LED, and a second resistor, the second switch and the at least one second LED being connected in series, and the second resistor and the at least one second LED being connected in parallel, the second resistor having a significantly different resistance value than the first resistor, the first user interface circuit and the second user interface circuit being connected in parallel.

In either case, the shelf circuit portion or the main circuit portion can have a capacitor connected in series across the power supply to the first and second resistors, so that selective actuation of the first or second switch will disengage the LED serially connected to the actuated switch, causing voltage to rise in the capacitor at a rate determined by the resistance value of the resistor serially connected to the actuated switch, which rate is timed by the voltage comparator and signaled to the refrigerator controller. Hence, the refrigerator controller can identify which switch is actuated.

In another embodiment, the shelf circuit portion comprises a touch sensor switch, a microprocessor, a voltage regulator, a capacitor, and at least two parameter circuits, each parameter circuit corresponding to a predetermined microenvironment within the compartment, and each parameter circuit comprising an LED, an LED resistor and an LED drive transistor, serially connected. The parameter circuits, microprocessor, touch sensor switch are connected in parallel, and the main circuit portion has a microprocessor. Thus, actuation of the touch sensor switch for a selected setting sends a signal corresponding to the selected setting to the main circuit portion microprocessor by way of the power bus. Preferably, actuation of the touch sensor switch signals microprocessor 158 to disengage the LEDS for a set time value. Thus the selected setting can be received and stored by the main circuit microprocessor. Also, preferably, power to the shelf circuit portion is discontinued when the door is closed.

In a further aspect of the invention, the mounting means includes a shelf ladder and the removable shelf has a bracket that mounts to the shelf ladder to support at least a portion of the removable shelf by cantilever. Preferably, the power bus is within the shelf ladder.

In a further aspect of the invention, a microenvironment zone is partially defined by the removable shelf, and the removable shelf comprises a user interface that controls at least one atmospheric parameter within the microenvironment zone. Here, the refrigerator has a control circuit for controlling the at least one atmospheric parameter. The removable shelf comprises a shelf portion of the control circuit, and a main portion of the control circuit is disposed remotely of the removable shelf. Thus, the shelf circuit portion is powered by way of the power bus when the removable shelf is mounted within the compartment by the mounting means. Preferably, the power bus comprises a ground conductor and a power conductor, the power conductor comprising separate sections, one section for each microenvironment zone. And further, the refrigerator comprises visual indicia to indicate the location of each microenvironment zone.

DETAILED DESCRIPTION

Figure 1:
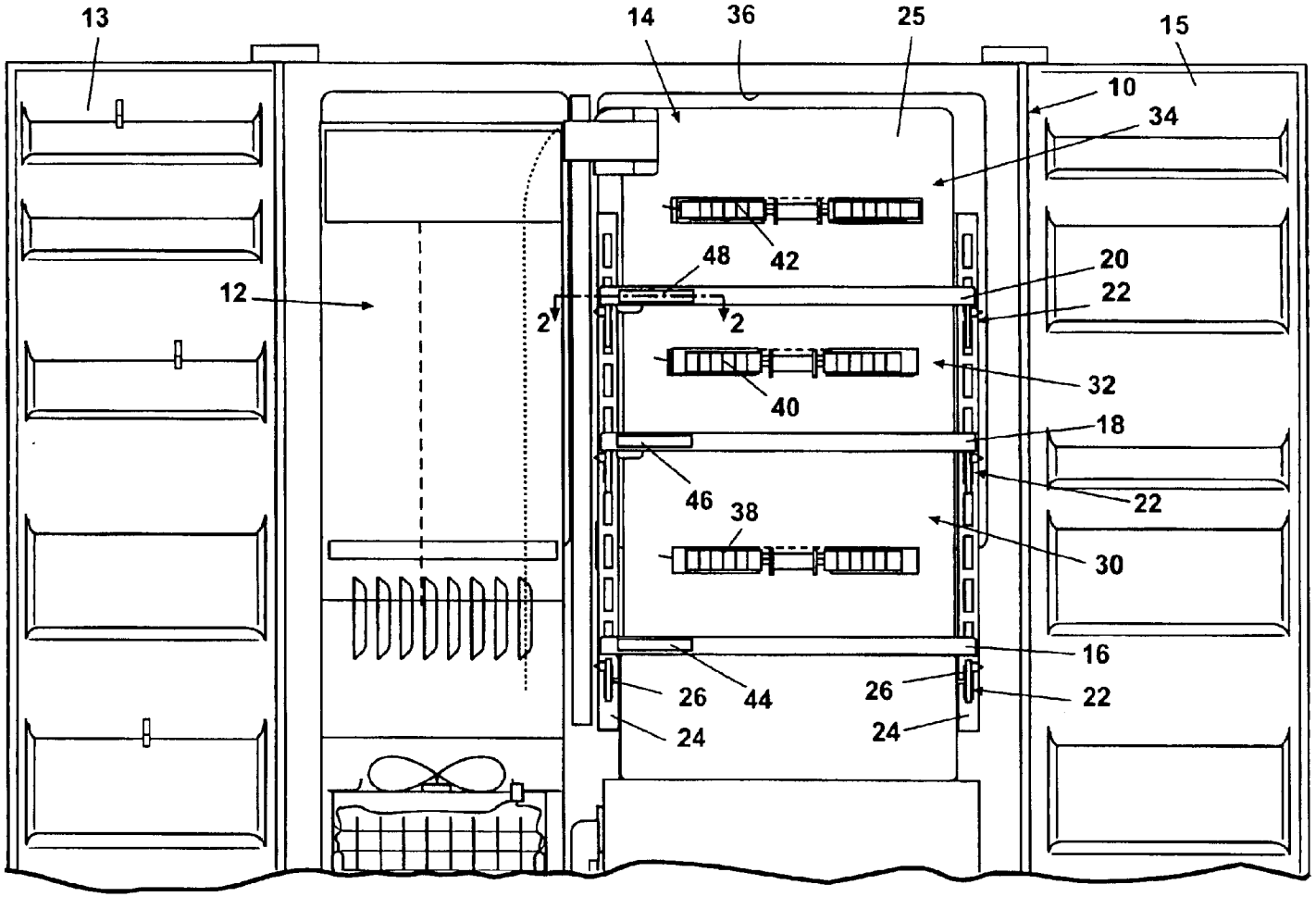
FIG. 1 is a front plan view of one embodiment of a refrigerator incorporating a power bus in a shelf ladder according to the invention.

FIG. 1 illustrates an upper portion of a first embodiment of a refrigerator 10 according to the invention. The refrigerator 10 comprises, side-by-side, a freezer compartment 12, selectively enclosable by a hinged door 13, and a refrigeration compartment 14, selectively enclosable by a hinged door 15. In this embodiment, the improvement according to the invention appears in the refrigeration compartment 14. It will be understood that the invention is not so limited, and is equally applicable in any compartment of a refrigerator 10.

The refrigeration compartment 14 contains three removable shelves 16, 18, 20, each of which is removably mounted within the compartment by a mounting means 22. In this embodiment, the mounting means 22 comprises a pair of shelf ladders 24 mounted vertically to a rear wall 25 in the refrigeration compartment 14, and a pair of mounting brackets 26 for each shelf. A pair of mounting brackets 26 is mounted to each shelf 16, 18, 20, spaced from each other the same distance that the shelf ladders 24 are spaced from each other, and the mounting brackets 26 are hung on the shelf ladders 24. Thus, the shelves 16, 18, 20 are removably cantilevered from the shelf ladders 24 and can be selectively repositioned by a user. More or fewer removable shelves can be provided for given refrigerator 10, as desired.

Each shelf 16, 18, 20 defines the bottom edge of a corresponding microenvironment zone 30, 32, 34. The top edge of each microenvironment zone is defined by the adjacent shelf immediately above the shelf defining the bottom edge of that microenvironment zone, except in the case of the top shelf 20, where the top edge of the microenvironment zone 34 is defined by an upper wall 36 of the refrigeration compartment 10. Each zone 30, 32, 34 has a corresponding temperature source 38, 40, 42 by which the temperature in each corresponding zone can be altered. An acceptable temperature source can be any one or a combination of diffusers, baffles, conduits, fans, heat exchangers, pumps, heating elements, and the like. Each shelf 16, 18, 20, respectively, has a user interface 44, 46, 48 that controls the temperature in the corresponding microenvironment zone 30, 32, 34.

Figure 2:
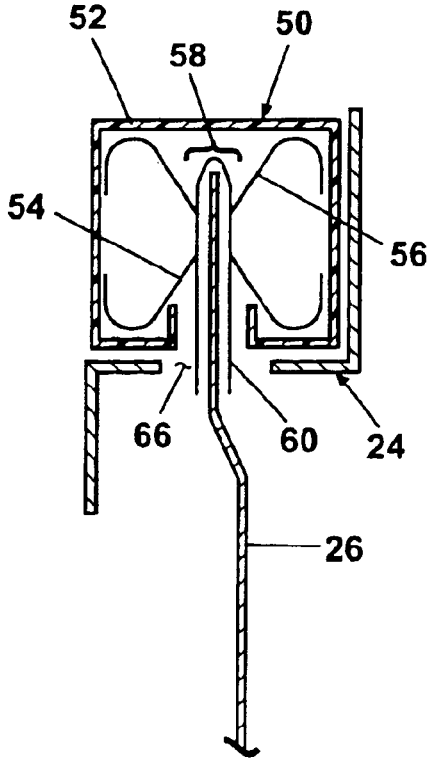
FIG. 2 is a partial cross-section taken along line 2—2 in FIG. 1.
Figure 3:
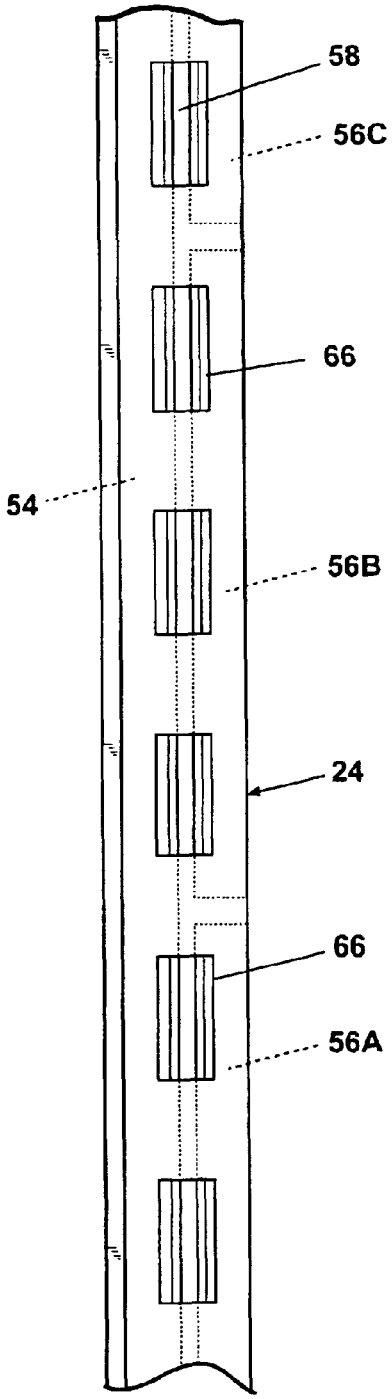
FIG. 3 is a partial front view of the shelf ladder of FIG. 1.

Looking now at FIGS. 2 and 3, it can be seen that power is delivered to the shelves 16, 18, 20 by way of a power bus 50 collinear with one of the shelf ladders 24. The power bus 50 comprises a dielectric support 52 that carries a common (or ground) conductor 54 and a power conductor 56, all disposed within (or behind) the shelf ladder 24. In this embodiment, the common conductor 54 is continuous, but the power conductor is separated into sections 56A, 56B, and 56C. Each section is located to power a corresponding microenvironment zone 30, 32, 34, respectively. Preferably, the common conductor 54 and the power conductor 56 are sprung and separated by a small gap 58. A connector 60 mounted to one of the shelf mounting brackets 26 is placed into contact with the common conductor 54 and the power conductor 56 by filling the gap 58 when the mounting bracket 26 is mounted to the shelf ladder 24.

Figure 4:
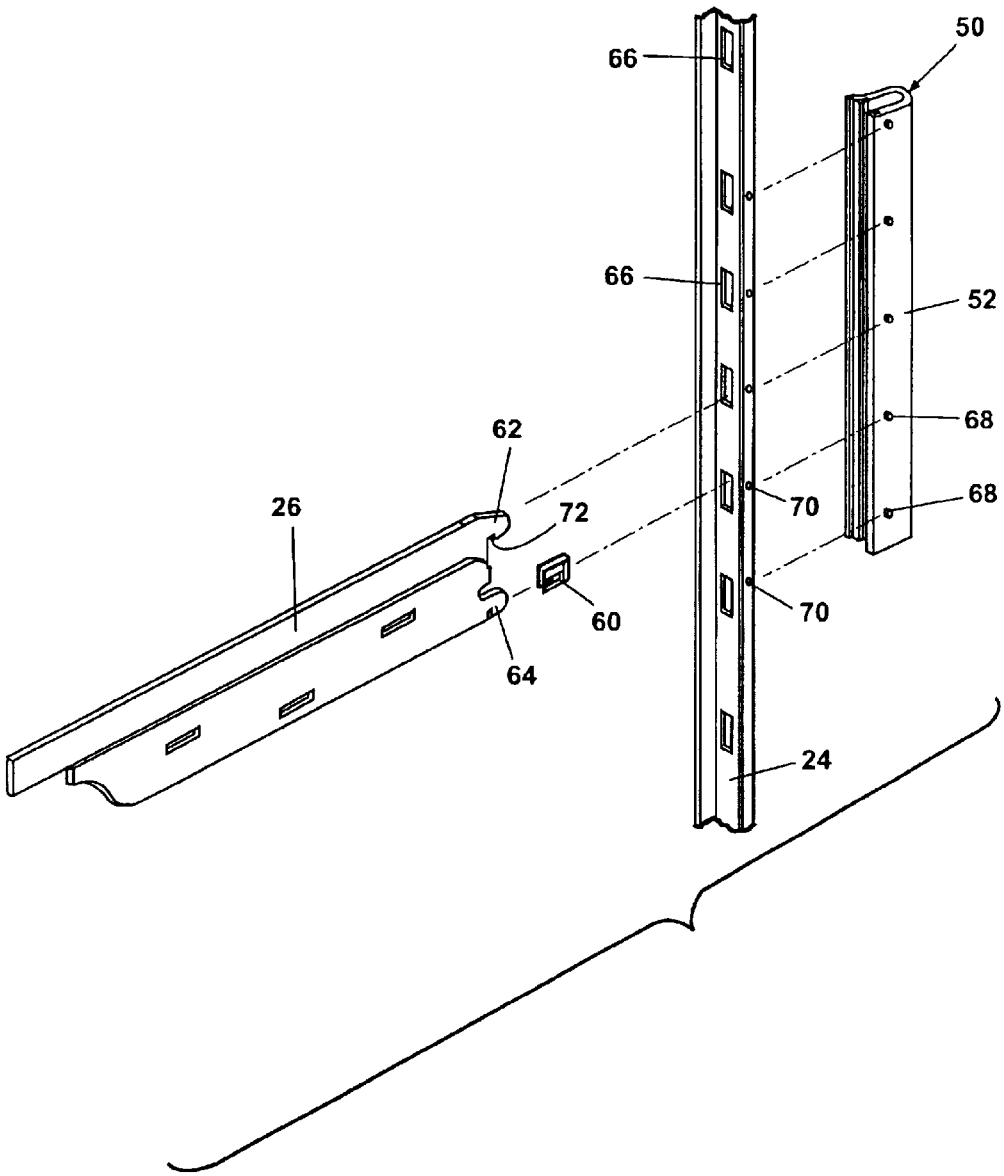
FIG. 4 is an exploded perspective view showing an embodiment of a shelf bracket, terminal clip, shelf ladder, and conductor support according to the invention.

Referring now also to FIG. 4, the relative arrangement of the shelf mounting bracket 26, the connector 60, the shelf ladder 24 and the power bus 50 can be seen. The shelf mounting bracket 26 has a pair of tabs 62, 64 by which it can be hung on the shelf ladder 24. The shelf ladder 24 has a number of slots 66 in its face, sized and spaced to receive the tabs 62, 64 of the shelf mounting bracket 26. In this example, the power bus 50 is mounted in the refrigerator compartment 14, behind the slots 66 of the shelf ladder 24. For example, as illustrated in FIG. 4, the dielectric support 52 can have pins 68 that snap into holes 70 along one side of the shelf ladder 24 to secure the power bus 50 to the shelf ladder 24. Here, the shelf ladder 24 is placed against a corner of the refrigeration compartment so that the power bus 50 will likewise be held against the corner by the shelf ladder to which it is secured. The connector 60 is held in place over one of the tabs (here the lower tab 64). It can be secured thereto by friction, pins, staking, welding, adhesives or other well-known methods. In this embodiment, the shelf mounting bracket 26 is mounted to the shelf ladder 24 by inserting the tabs 62, 64 into two of slots 66. The upper tab 62 has a notch 72 that rests over the lower edge of the corresponding slot to hang the bracket on the shelf ladder 24. While the lower tab 24 may or may not also have a notch, more importantly, it carries the connector 60, which is received within the gap 58 of the power bus 50, to make contact with the common conductor 54 and the power conductor 56.

Figure 5:
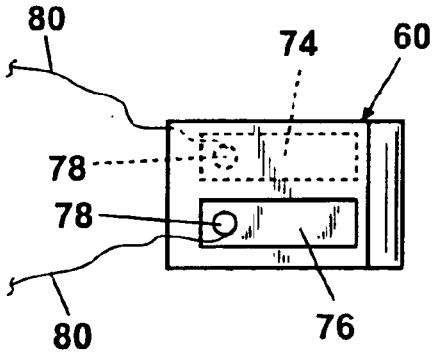
FIG. 5 is a side view of the terminal clip of FIG. 4.

Looking now at FIG. 5, the connector 60 has an anode contact 74 and a cathode contact 76, on opposite sides of the connector. Each contact 74, 76 has a terminal 78 to which a circuit lead 80 is connected. The circuit lead 80 may be a wire or other conductor, sufficient to convey power as may be required by a circuit on the shelf.

Figure 6:
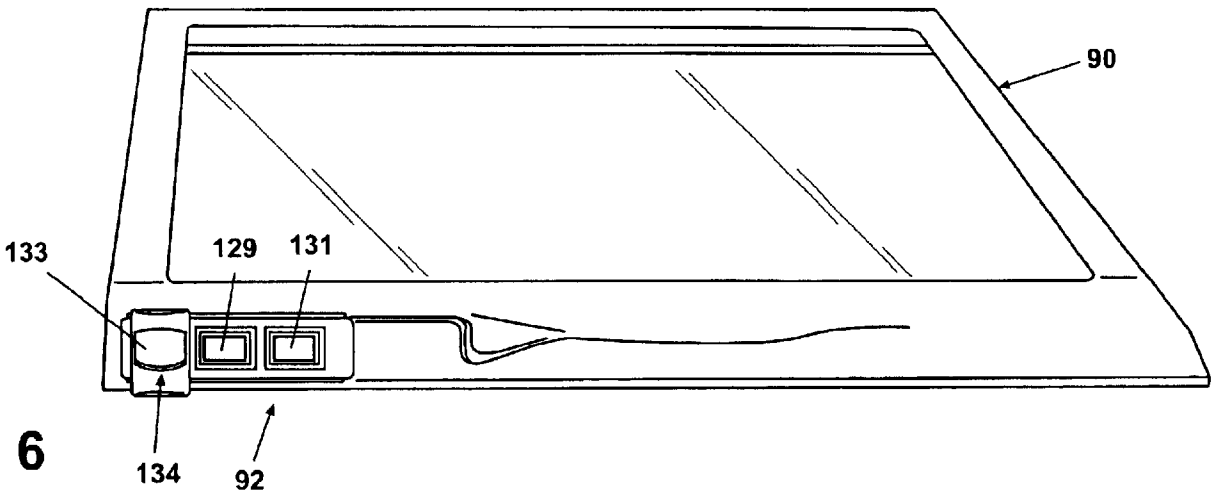
FIG. 6 is a front perspective view of an embodiment of a shelf incorporating a user interface according to the invention.
Figure 10:
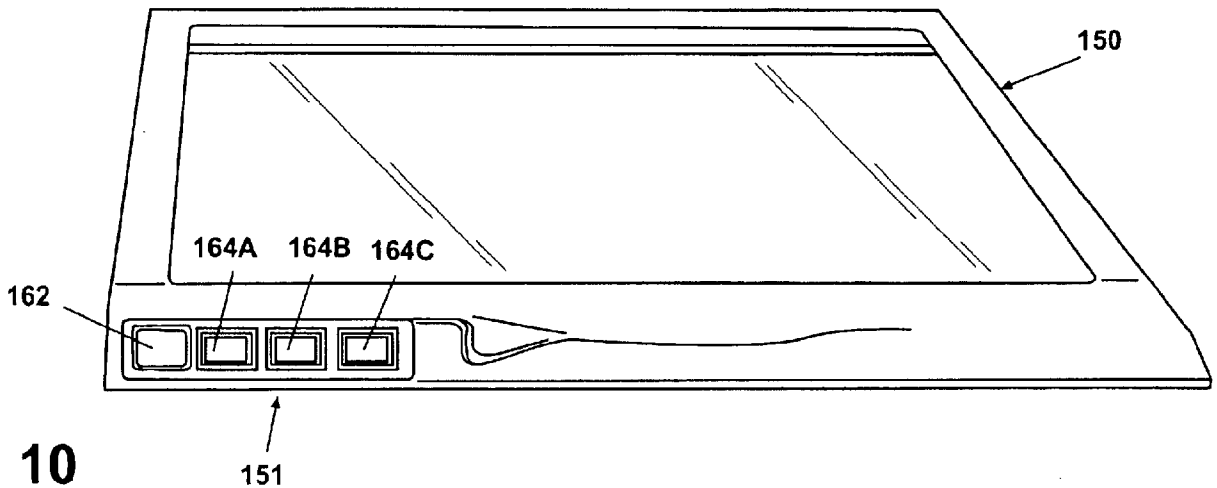
FIG. 10 is a front perspective view of another embodiment of a shelf incorporating a user interface according to the invention.
Figure 7:
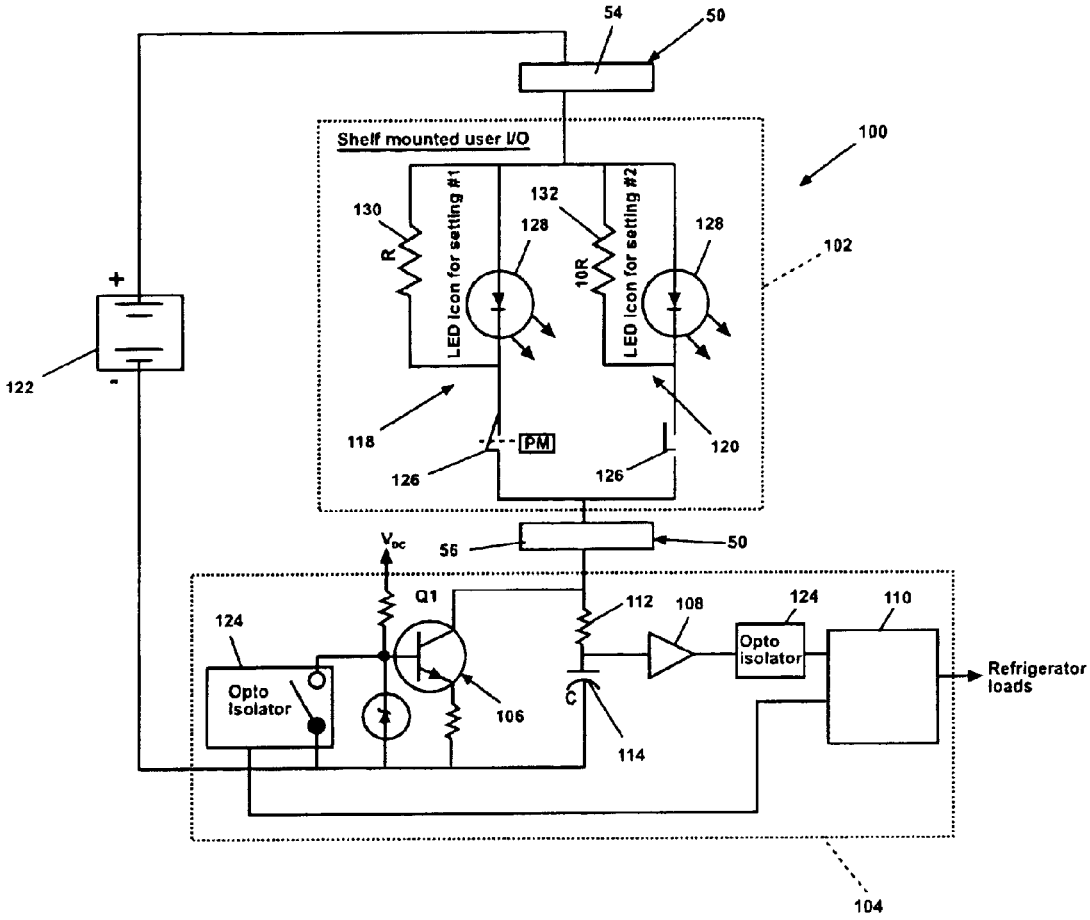
FIG. 7 is a schematic diagram showing a main circuit portion and a shelf circuit portion as might be incorporated into the shelf embodiment of FIG. 6.
Figure 8:
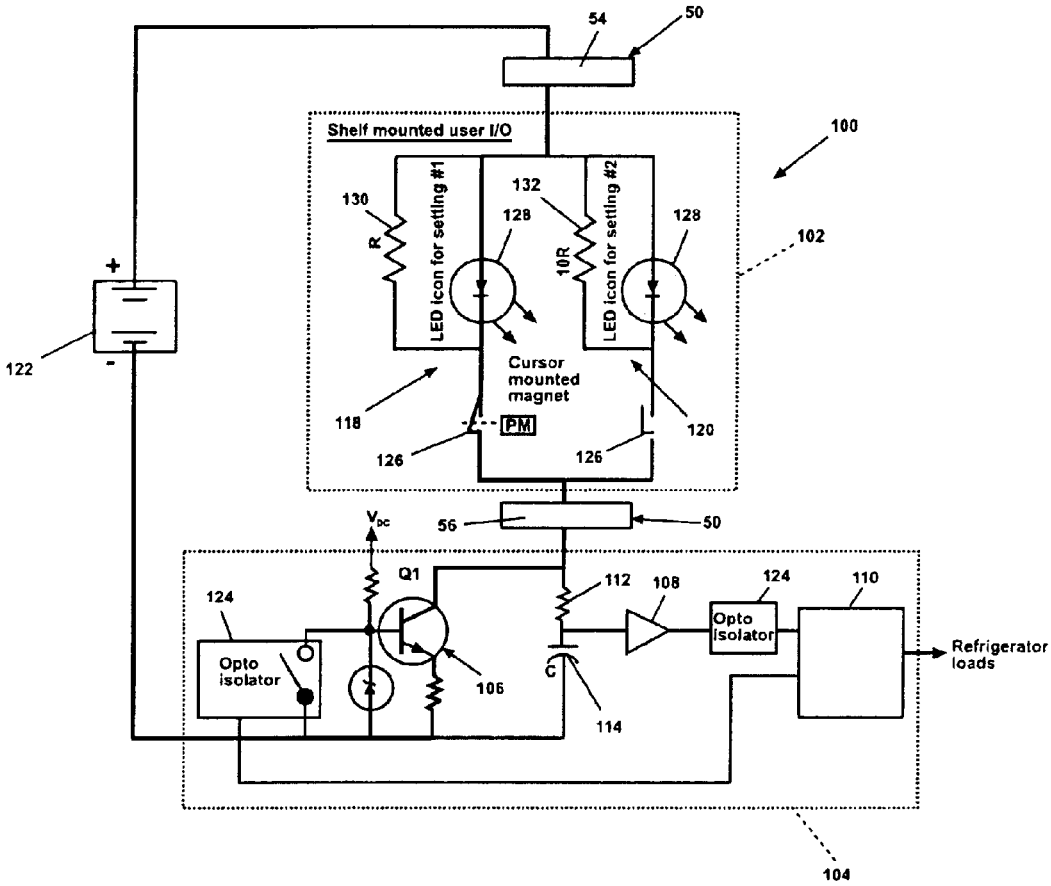
FIG. 8 is a schematic diagram showing a current path of a first mode in the circuit of FIG. 7.

FIGS. 6–8 illustrate one embodiment of a shelf 90, adapted to function with a circuit 100 according to the invention. A user interface 92 is disposed on the front of the shelf 90. The circuit 100 comprises a shelf circuit portion 102 that is located on or in the shelf 90, and a main circuit portion 104 that is located elsewhere in the refrigerator 10, typically in a fixed location. Thus, the shelf circuit portion 102 is removable from the main circuit portion 104, since the shelf 90 is removable from the refrigerator 10, as, for example, by removing it from the shelf ladder 24. The main circuit portion 104 comprises a constant current source 106, a voltage comparator 108, and a refrigerator control 110. A resistor 112 and a capacitor 114 parallel the constant current source 106 between the constant current source and the voltage comparator 108. The user interface 92 is capable of altering an environmental parameter within the adjacent microenvironment zone associated with the shelf 90, typically, the space immediately above the shelf. Here a first user interface 118 and a second user interface 120 are shown in the shelf circuit portion 102, each designed to set a different temperature in the adjacent microenvironment zone.

Since the shelf 90 is user removable, at least the shelf circuit portion 102 and perhaps part of the main circuit portion 104 preferably operate with a class 2 isolated power supply 122, typically at 24 volts. Here, the shelf circuit portion 102, the constant current source 106 and the voltage comparator 108 are all driven by the isolated power supply 122. The refrigerator control 110, however, is tied to line voltage at 110 volts, as are most of the other refrigerator loads controlled by the refrigerator control, e.g., compressors, motors and the like. To maintain the class 2 supply integrity, data transfer between the shelf circuit portion 102 and the refrigerator control 110 is done via opto isolators 124.

Each user interface 118, 120 comprises a switch 126, such as a reed switch or a slide switch serially connected to at least one LED 128 (here are shown as one). A resistor 130 at a first resistance value parallels the LED 128 in the first user interface 118, and a resistor 132 at a significantly different resistance value (here, ten times the first resistance value of the resistor 130) parallels the LED 128 in the second user interface 120. Each user interface 118, 120 has a display on the front of the shelf 90 (see FIG. 6), as for example, illuminating the LED's 128 behind separate windows 129, 131. A slide 134 on the front of the shelf can selectively operate the switches 126, by being positioned over the respective display 129, 131, the slide having a window 133 to permit illumination from the display to pass through it. Other forms of interface are well within the knowledge of those skilled in the art, such as a pressure switch at each display window, or a separate cycle switch where a user can cycle through different settings.

The circuit 100 functions in two modes: (1) an identification mode where the display (LED) identifies the current user setting, and (2) a data transmission mode where a user input selection is transferred to the refrigerator control 110. FIG. 8 illustrates the current path in bold while the circuit 100 is in the identification mode. The anode side of the isolated power supply 122 is connected to the common conductor 54 of the power bus 50. With the shelf 90 mounted in the refrigerator compartment and connected to the power bus 50, as, for example, if the shelf were mounted to the shelf ladder 24, current is delivered to the shelf circuit portion 102. Here the first user interface 118 is activated by user actuation of its switch 126. Thus, current flows through the LED 128 for this setting, the closed switch 126, and out through power conductor 56 for the zone to be controlled by the particular power conductor section 56A, 56B, or 56C to which the shelf 90 is connected. The user has made a non-volatile selection by actuating the switch 126. Current proceeds through the constant current source 106 and back to the cathode side of the isolated power supply 122. The constant current source 106 compensates for power supply voltage fluctuations and LED tolerances. More importantly it safely limits current should a short occur. Generally to save energy, the identification mode will be active only while the door 15 is open; current to the power bus 50 will normally be cut off when the door 15 is closed.

Figure 9:
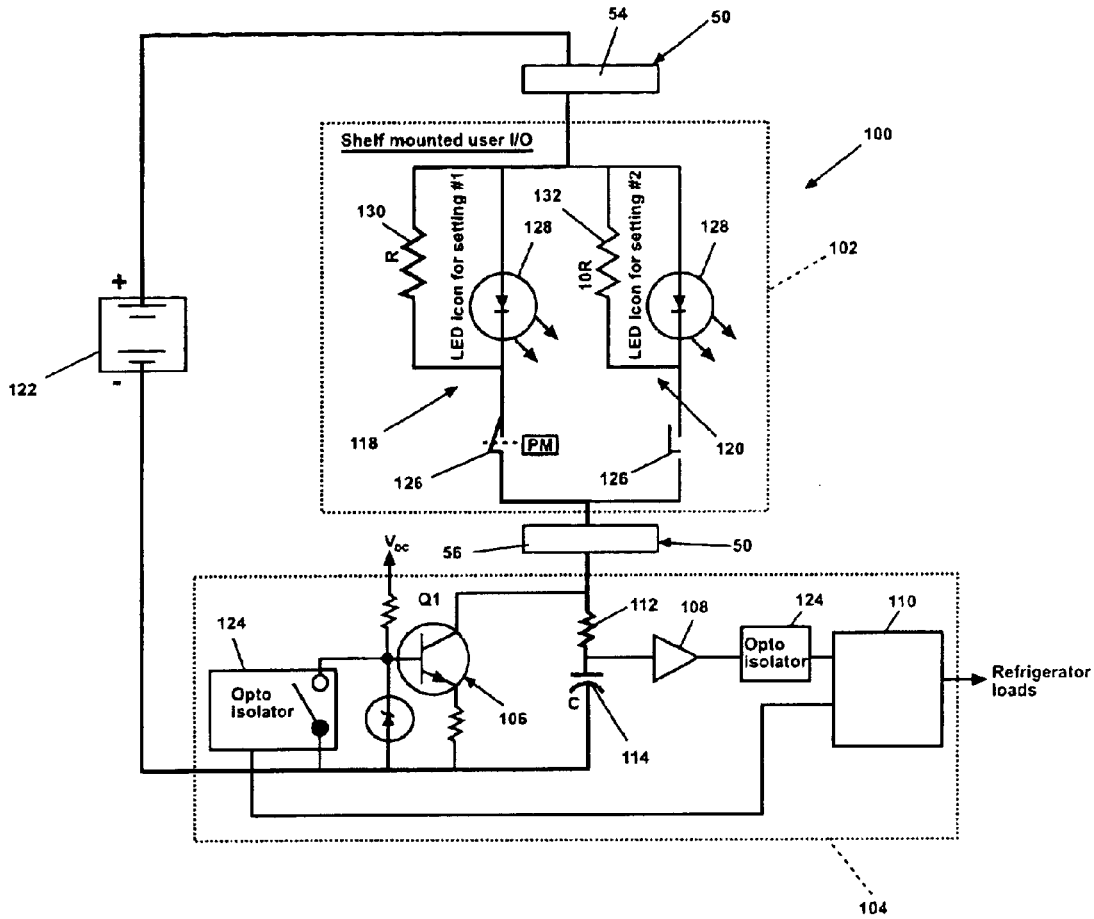
FIG. 9 is a schematic diagram showing a current path of a second mode in the circuit of FIG. 7.

FIG. 9 illustrates the current path in bold while the circuit 100 is in the data transmission mode. Preferably the constant current source 106 includes a transistor Q1. Periodically, the refrigerator control 110 shorts out the base of Q1, via an opto isolator, momentarily removing the current supply. Removing the current supply effectively takes the LED 128 out of the circuit due to its forward voltage current characteristic. The resistor 130 that parallels the LED 128 now becomes the path of choice. The capacitor 114 and this resistor 130 are now serially tied across the isolated power supply 122. Capacitor voltage will now rise at a rate determined by the resistor and capacitor values. The voltage comparator 108 monitors this rising voltage and changes states once a predetermined voltage is achieved, thus making an A to D conversion. Note that the resistance value of the resistor 130, 132 determines the time it takes the capacitor 108 to charge. Were the other user interface 120 engaged, the resistor 132 having a value ten times the first resistance value of the resistor 130 would greatly slow the capacitor charge rate. The refrigerator control 110 monitors the time it takes for the comparator 108 to trip. The time value tells the control 110 which user interface (118 or 120) has been selected. It will be apparent that in the data transmission mode, no LED 128 is on, since the data signal is transmitted over the power bus 50. However, each data transfer time is so short that the time the LED is turned off is not perceivable to the eye. The refrigerator control 110, in turn, scans appropriate temperature sensors, powers up any compressor and or fans needed to change temperature in the selected zone, changing baffle settings and the like to achieve the zone temperature selected by the user from the shelf 90. In this aspect of the invention, it will be apparent that the power and data are transmitted over the same power bus, greatly simplifying construction a reducing cost.

Figure 11:
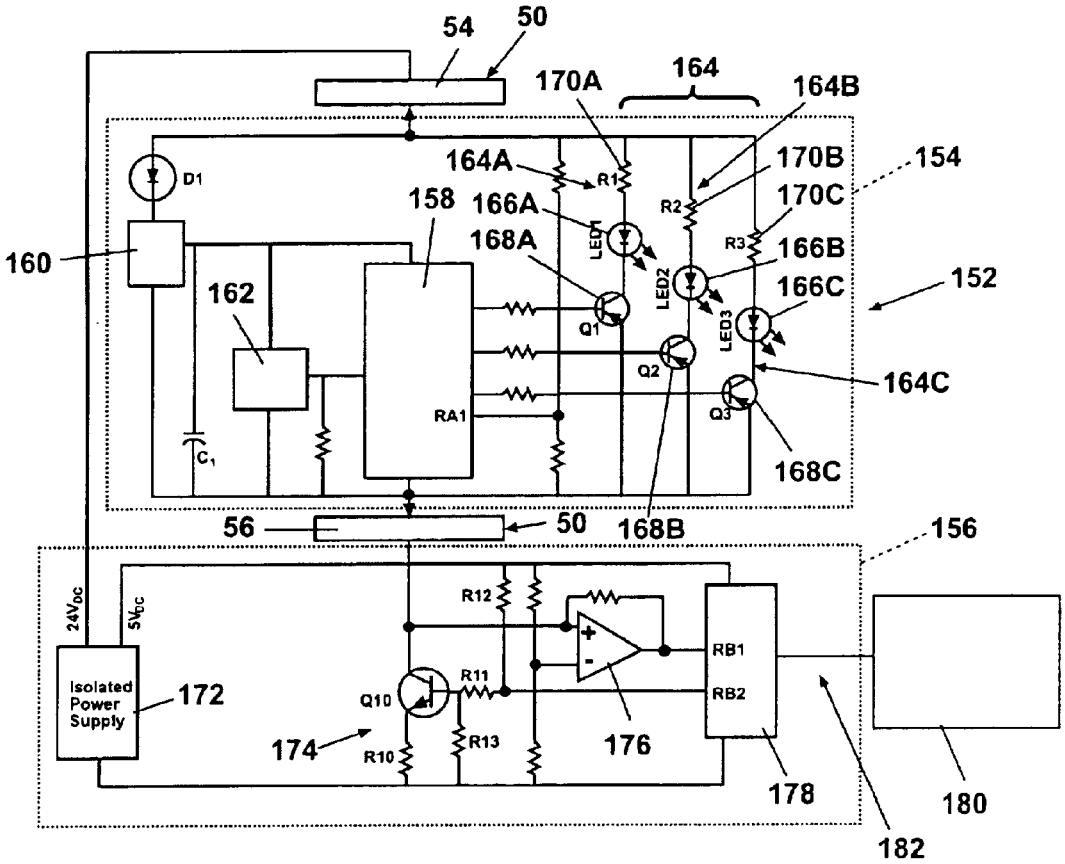
FIG. 11 is a schematic diagram showing a main circuit portion and a shelf circuit portion as might be incorporated into the shelf embodiment of FIG. 10.

Another embodiment of a removable shelf 150 and a circuit 152 in accord with the invention is illustrated in FIGS. 10–14. While the circuit of FIGS. 6–9 is primarily analog (with a non-volatile user setting), the configuration of FIGS. 10–14 is primarily digital. The shelf 150 includes a user interface 151 toward the front of the shelf where it is easily accessible to a user and not subject to obstruction. The circuit 152 comprises a shelf circuit portion 154 and a main circuit portion 156. The shelf circuit portion 154 is disposed on or in the shelf 150, and comprises a shelf microprocessor 158 that receives driving current by way of a voltage regulator 160, preferably at 5 volts. A touch sensitive switch 162 is connected to an input of the microprocessor 158. A set circuit 164 is provided for each set point of the parameter or parameters of the microenvironment zone to be controlled. Thus, for example, FIG. 11 illustrates three set circuits 164A, 164B, and 164C. Set circuit 164A has an LED 166A, a drive transistor 168A for the LED, and a resistor 170A. Similarly, set circuit 164B has an LED 166B, a drive transistor 168B for the LED, and a resistor 170B, and set circuit 164C has an LED 166C, a drive transistor 168C, and a resistor 170C. Also present are a capacitor C1 and a diode D1.

Figure 12:
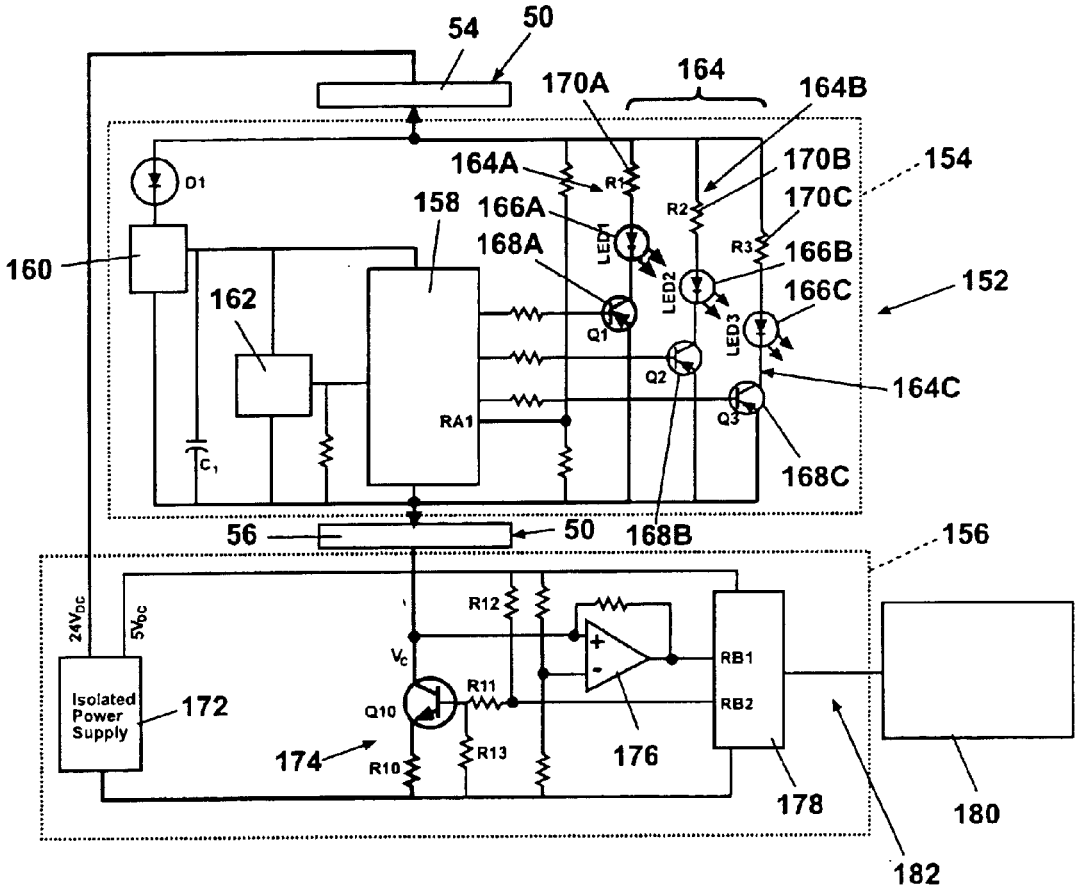
FIG. 12 is a schematic diagram showing a current path of a first mode in the circuit of FIG. 11.
Figure 12A:
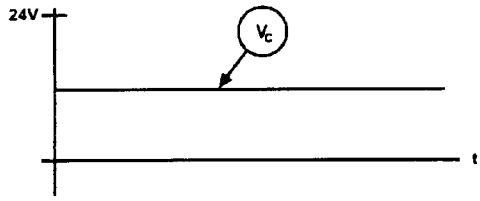
FIG. 12A is a chart plotting the voltage at the constant current source transistor in the circuit of FIG. 1I over time in the first mode.
Figure 13:
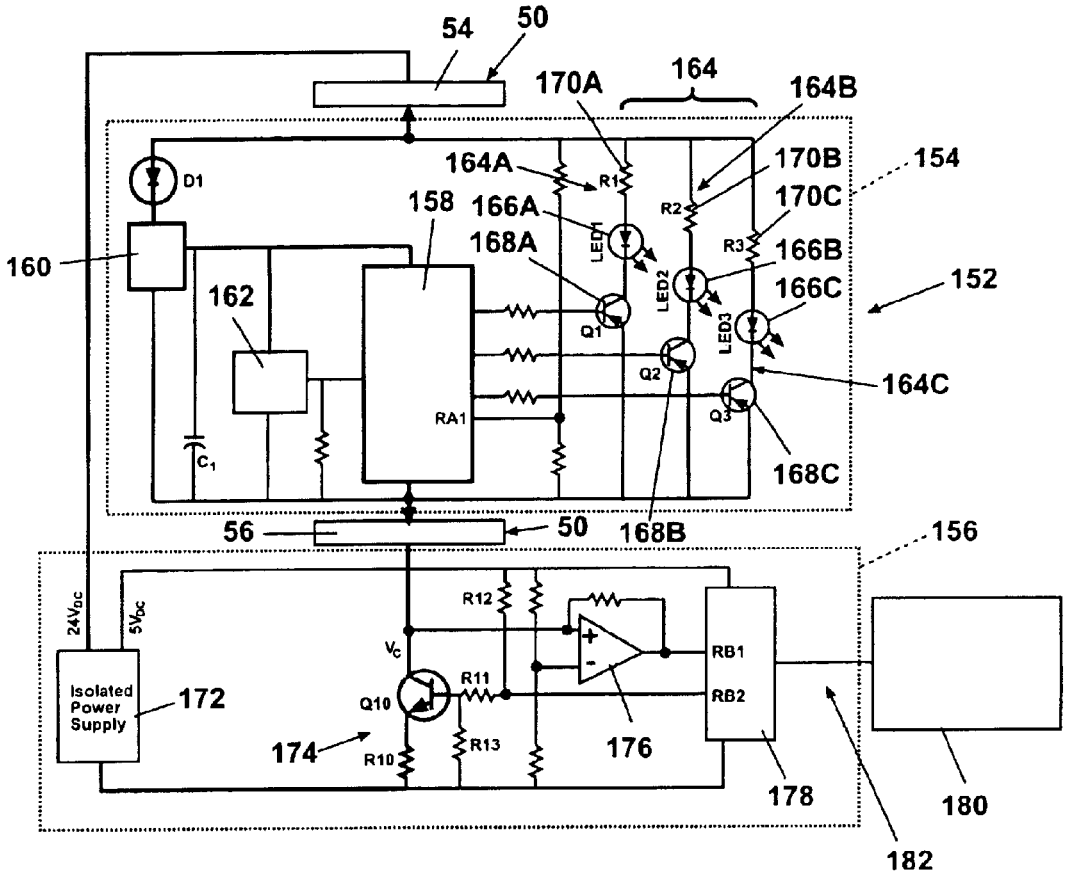
FIG. 13 is a schematic diagram showing a current path of a second mode in the circuit of FIG. 11.
Figure 13A:
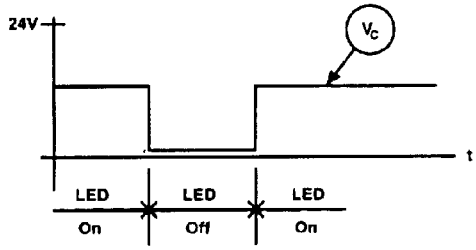
FIG. 13A is a chart plotting the voltage at the constant current source transistor in the circuit of FIG. 11 over time in the second mode.

The main circuit portion 156 is located remotely from the shelf 150, preferably fixed in the refrigerator cabinet in a position to control operation of some or all aspects of the refrigerator. The main circuit portion 156 comprises an isolated power supply 172, a constant current source 174, a voltage comparator 176 and a main microprocessor 178. The isolated power supply 172 provides current at 24 volts to the shelf circuit portion 154, as well as to the main circuit portion 156. The constant current source 174 comprises a transistor Q10, and resistors R10, R 11, R12, and R13. The resistor values are chosen to source current at a constant 25 ma. The collector voltage of the transistor Q10, indicated as $V_c$ in FIGS. 12A, 13A and 14A, is monitored by the main microprocessor 178 through the voltage comparator 176. It will be understood that a constant current source and a voltage comparator are required for each microenvironment zone, for which one shelf will be provided with a circuit to control each zone. The isolated power supply 172 and the main microprocessor 178 are common to all zones.

When the shelf 150 is connected to the power bus 50, the shelf circuit portion 154 connects to the anode of the isolated power supply 172 via the common conductor 54 in the power bus. The other end of the shelf circuit portion 154 returns to the isolated power supply 172 via the section of the power conductor 56 in the power bus slated to control the microenvironment zone for which the shelf 150 defines the lower edge, and the constant current source 174. Preferably, The LED resistors 170A, 170B, and 170C are sized so that the voltage drop across them, plus the LED forward voltage drop, plus the LED drive transistor saturation voltage all add up to a voltage drop across the set circuits 164A, 164B, and 164C equal to or less then one half of the 24 volts from the isolated power supply 172.

The circuit 152 has three modes of operation: (1) active, (2) download, and (3) upload. The current path in the active mode is highlighted in bold in FIG. 12. The active mode is a steady state and pertains whenever the refrigerator door is open and the shelf 150 is exposed to the user. The set circuit last selected by the user (here for illustration, set circuit 164A) corresponds to the selected temperature for the microenvironment zone associated with the shelf 150. The LED 166A is active, illuminated, and the light therefrom is visible on the front of the shelf 150. The LED 166A is also the major current user. The collector of transistor Q10 in the constant current source 174 will raise or lower its voltage $V_c$ until the voltage across the shelf circuit portion is just right to draw 25 ma. $V_c$ is above the threshold of the voltage comparator 176, thereby placing a logic level "1"on input pin RB 1 of the main microprocessor 178. FIG. 12A illustrates the steady state of the collector voltage $V_c$ at about half or less than the voltage of the isolated power supply 172.

The download mode pertains whenever the user desires to change a temperature (or other parameter) setting for the microenvironment zone controlled from the shelf 150. The current path for the download mode is highlighted in bold in FIG. 13. When the user changes the parameter setting, the shelf microprocessor 158 must download this data to the main microprocessor 178 in addition to updating the appropriate set circuit so that the display on the shelf 150 is current.

As the user actuates the touch sensitive switch 162, the shelf microprocessor 158 turns off all of the set circuit LEDs 166A, 166B, and 166C for a set time. The set time corresponds to the particular setting desired by the user in accord with actuation of the touch sensitive switch 162. For example, actuation of the touch sensitive switch 162 for a first setting may correspond to a set time of 100 microseconds, a second setting 200 microseconds, and so on. When the set circuit LEDs 166A, 166B, and 166C are turned off, current draw by the shelf circuit portion 154 is greatly reduced. Only enough current to sustain the microprocessor 158 is needed. The constant current source 174 in the main circuit portion 156 strives to maintain a current flow of 25 ma. $V_c$ of the transistor Q10 drops to near zero volts, thus placing greater voltage across the shelf circuit portion 154 in an effort to get a 25 ma current flow. $V_c$ is now below the voltage comparator threshold, tripping the voltage comparator and thus changing the RB 1 input of the main microprocessor 178 from a logic level "1" to a logic level "0". The shelf microprocessor 158 stays in this mode for the set time according to the selection by the user. For instance, if the user had selected the second setting, the shelf microprocessor 158 would have turned off the LEDs 166A, 166B, and 166C for a set time of 200 microseconds, during which time $V_c$ would be below the voltage comparator threshold and the RB 1 input of the main microprocessor 178 would be at logic level "0". Meanwhile, the main microprocessor 178 clocks the set time, and at the end of the set time, registers and stores the corresponding setting desired by the user. Based on that setting, the main microprocessor 178 signals, through an opto isolated serial connection 182, a refrigerator control 180 that operates the systems needed to achieve the desired setting within the microenvironment zone. Also, the shelf microprocessor 158 turns on the LED or LEDs corresponding to the selected setting at the end of the set time. It will be understood that the set times are so short that the time that the LEDs remain off is imperceptible to the eye.

Figure 14:
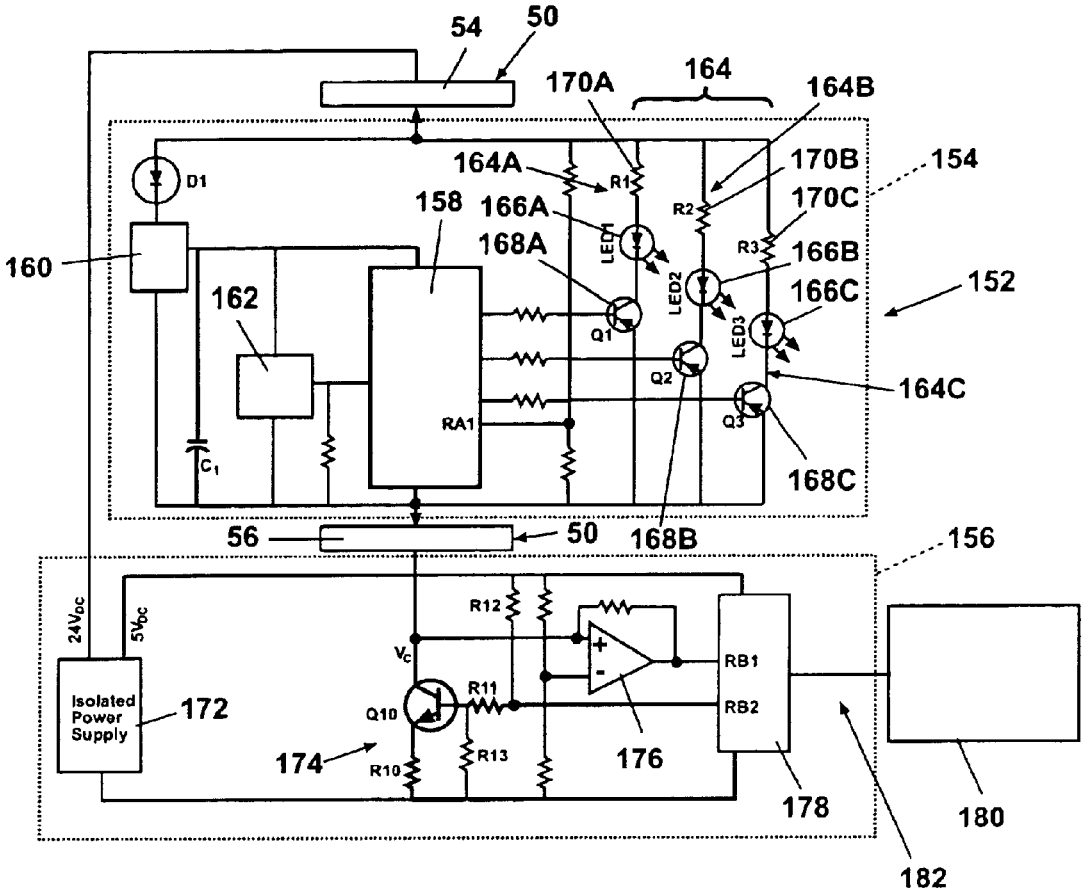
FIG. 14 is a schematic diagram showing a current path of a third mode in the circuit of FIG. 11.
Figure 14A:
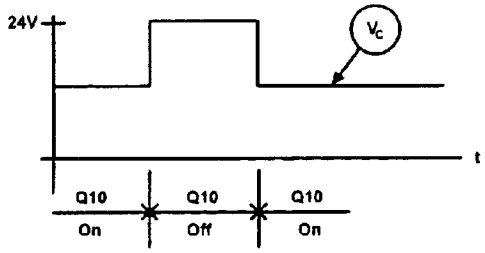
FIG. 14A is a chart plotting the voltage at the constant current source transistor in the circuit of FIG. 11 over time in the third mode.

The current path of the upload mode is highlighted in bold in FIG. 14. To save energy, the shelf microprocessor 158 will probably be shut off while the door to the refrigerator compartment is closed. Typically, the memory in the shelf microprocessor 158 is volatile, so any setting stored therein is lost upon door closure. However the correct setting remains stored in the main microprocessor 178 and is used to maintain the desired temperature in that corresponding microenvironment zone. When the door is reopened, the main microprocessor 178 must upload the setting information to the shelf microprocessor 158 so that it can display the proper LED to the user. It does so by manipulating the constant current source 174. As the door is opening, the circuit 152 is put into the active mode just long enough to charge up capacitor C1 and boot up the shelf microprocessor 158 in the shelf circuit portion 154. At this point RA 1 is read as a logic level "1"by the shelf microprocessor 158. This preparatory action occurs before the door is completely open. Upload is ready to occur upon rebooting the shelf microprocessor 158. Uploading is accomplished by shutting the constant current source off for the set time corresponding to the existing setting stored in the main microprocessor 178. This occurs by the main microprocessor 178 setting RB2 to "0", thus effectively removing the transistor Q10 base drive. During this time all 24 volts of the isolated power supply 172 drop across the transistor Q10, leaving zero volts across the shelf circuit portion 154. The shelf microprocessor 158 recognizes this condition because RA 1 drops from a logic level "1"to a logic level "0". Meanwhile, charge stored up in capacitor C1 becomes the power source for the shelf microprocessor 158. Diode D1 protects the voltage regulator 160 from a negative input and blocks the LEDs from drawing charge off of C1. Just as in the downloading process, time in this mode indicates the setting. In the present example, after the set time of 200 microseconds, RB2 returns to a logic level "1", thus returning transistor Q10 to its constant current mode of operation. The shelf microprocessor 158 signals the appropriate setting to the set circuit 164, for example, illuminating LEDs 166A and 166B to display the second setting. As with the download mode, the set times are too short for the human eye to perceive. Capacitor C1 must be sized to power the shelf microprocessor 158 during this upload period.

Among the benefits of the invention is that the shelf circuit portion 154 is position insensitive and does not require an address. In other words, a user can remove the shelf for cleaning or replacement, and reinstall it anywhere in the refrigeration compartment, so long as no more than one shelf is disposed in a single zone. The "zone" setting is stored in the main microprocessor 178, not the shelf microprocessor 158. In order to avoid mounting more than one shelf in a single zone, visual indicia can be located somewhere in the refrigerator, e.g., on the shelf ladder 24 to indicate breaks between power conductor sections of the power bus 50.

Figure 15:
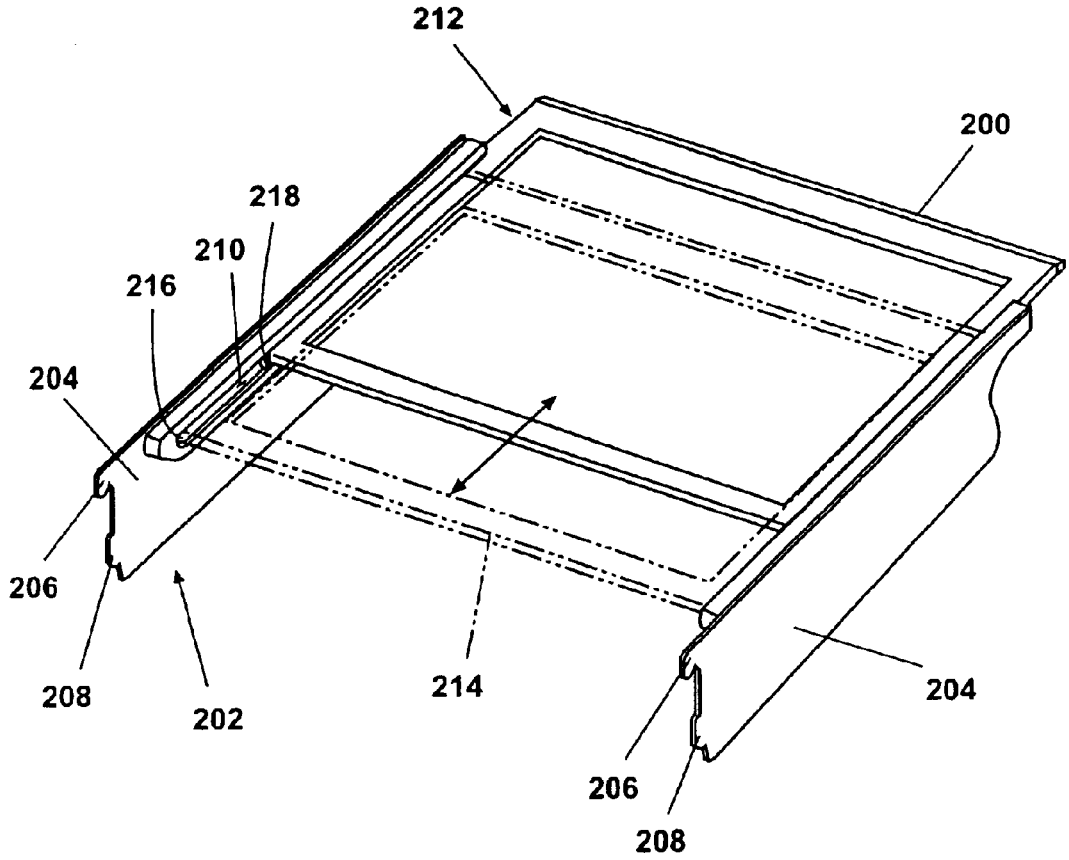
FIG. 15 is a perspective view of an embodiment of a slidable shelf for a refrigerator according to the invention.

Another embodiment of a shelf 200 and a portion of its mounting means 202 according to the invention are illustrated in FIG. 15. Here, the shelf 200 is slidably mounted to the mounting means 202, as is common in many refrigerators. The mounting means 202 comprises a pair of mounting brackets 204, each having at least one tab 206 adapted to hang on a shelf ladder (not shown) of the type illustrated in FIGS. 1 and 2. Thus, the slidable shelf 200 would be cantilevered from the shelf ladder as explained earlier. A connector located at tab 208, perhaps of the construction illustrated in FIG. 5, is affixed to one of the mounting brackets 204. The shelf 200 is slidable in a track 210 between an extended position 212 (as illustrated) and a retracted position 214 (shown in phantom). A contact at the proximal end 216 of the track 210 is electrically connected to the connector located at tab 208, so that it will establish a connection to a terminal 218 on the shelf 200 when the shelf is in the retracted position 214. Thus, any circuit in or on the shelf 200 can receive power and/or transmit data by way of a power bus (not shown) in accord with the invention. In this case, the connection between the contact 216 and the terminal 218 will be broken when the shelf 200 is away from the retracted position 214, e.g., in the extended position 212.

Of course it is just as likely that a continuous contact can be provided in the track 210 to enable power to be delivered to the shelf 200, regardless of its slidable position relative to the mounting brackets 204.

Figure 17:
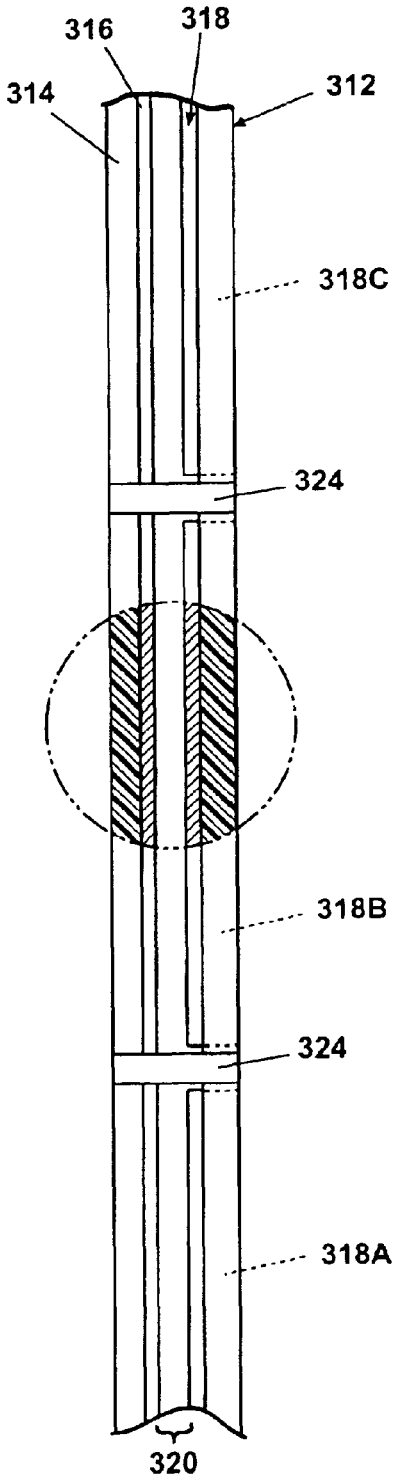
FIG. 17 is a partial front view of the power bus of FIG. 16.
Figure 16:
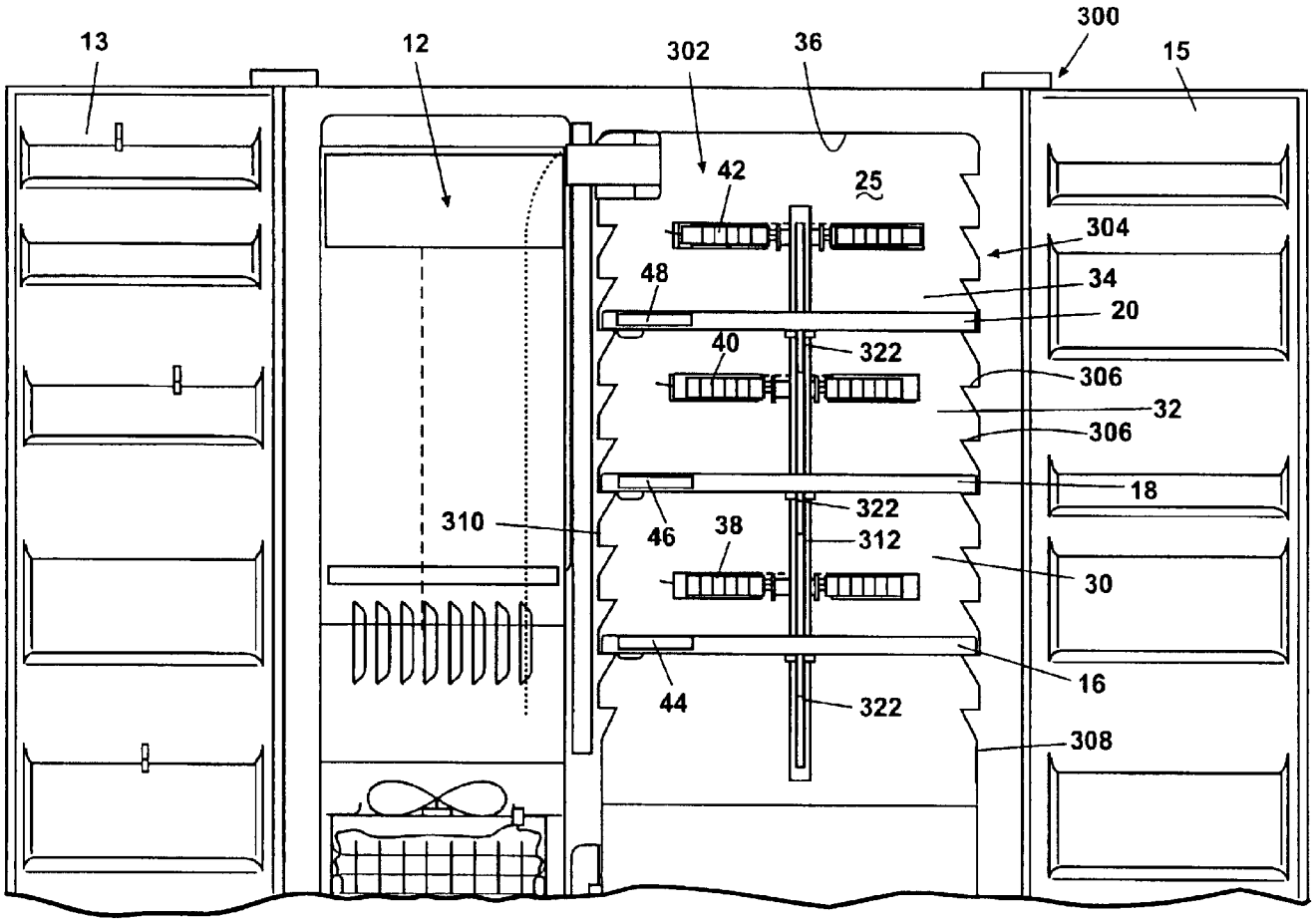
FIG. 16 a front plan view of another embodiment of a refrigerator incorporating a power bus according to the invention.

FIGS. 16 and 17 illustrates an upper portion of another embodiment of a refrigerator 300 according to the invention. Here, like numerals will identify like components to those of earlier embodiments. The refrigerator 300 comprises, side-by-side, a freezer compartment 12, selectively enclosable by a hinged door 13, and a refrigeration compartment 302, selectively enclosable by a hinged door 15. In this embodiment, the improvement according to the invention appears in the refrigeration compartment 302. It will be understood that the invention is not so limited, and is equally applicable in any compartment of a refrigerator 300.

The refrigeration compartment 302 contains three removable shelves 16, 18, 20, each of which is removably mounted within the compartment by a mounting means 304. In this embodiment, the mounting means 304 comprises a plurality of ledges 306 disposed on the side walls 308, 310 of the refrigeration compartment 302. Each of the shelves 16, 18, 20 rests on a pair of opposed ledges 306. Each shelf 16, 18, 20 defines the bottom edge of a corresponding microenvironment zone 30, 32, 34. The top edge of each microenvironment zone is defined by the adjacent shelf immediately above the shelf defining the bottom edge of that microenvironment zone, except in the case of the top shelf 20, where the top edge of the microenvironment zone 34 is defined by an upper wall 36 of the refrigeration compartment 10. Each zone 30, 32, 34 has a corresponding temperature source 38, 40, 42 by which the temperature in each corresponding zone can be altered. An acceptable temperature source can be any one or a combination of diffusers, baffles, conduits, fans, heat exchangers, pumps, heating elements, and the like. Each shelf 16, 18, 20, respectively, has a user interface 44, 46, 48 that controls the temperature in the corresponding microenvironment zone 30, 32, 34.

A power bus 312 is mounted to a rear wall 25 of the refrigeration compartment 302 at a location between the opposed ledges 306. The power bus 312 comprises a dielectric insulator 314 that carries a continuous common conductor 316 and a power conductor 318, broken into sections 318A, 318B, and 318C, each section corresponding to a single microenvironment zone 30, 32, 34, respectively. Preferably, the continuous common conductor 316 and power conductor 318 are sprung and separated from each other by a gap 320. A connector 322 mounted to each shelf engages the power bus 312 when the corresponding shelf is mounted on the ledges 306 by being inserted into the gap 320 where it connects to the continuous common conductor 316 and the section of the power conductor 318 corresponding to the zone in which the shelf is installed. Power delivery and data transmission can occur by way of the power bus 320 and connectors 322 to the shelves 16, 18, 20 as described earlier. Visual indicia 324 can be provided on the power bus (or in the refrigerator compartment) to indicate where different zones are located with respect to the sections of the power conductor 318.

Figure 18:
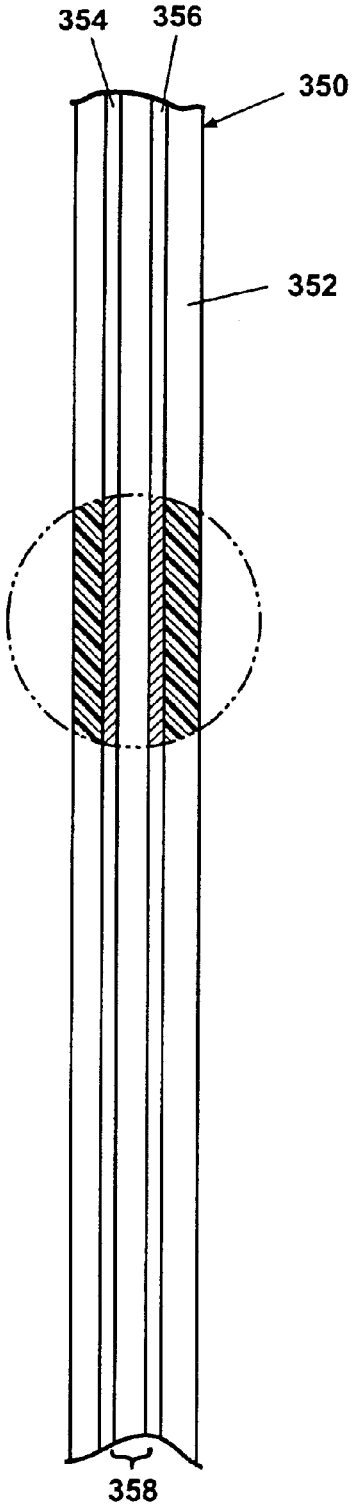
FIG. 18 is a partial front view of an alternative power bus according to the invention.
Figure 19:
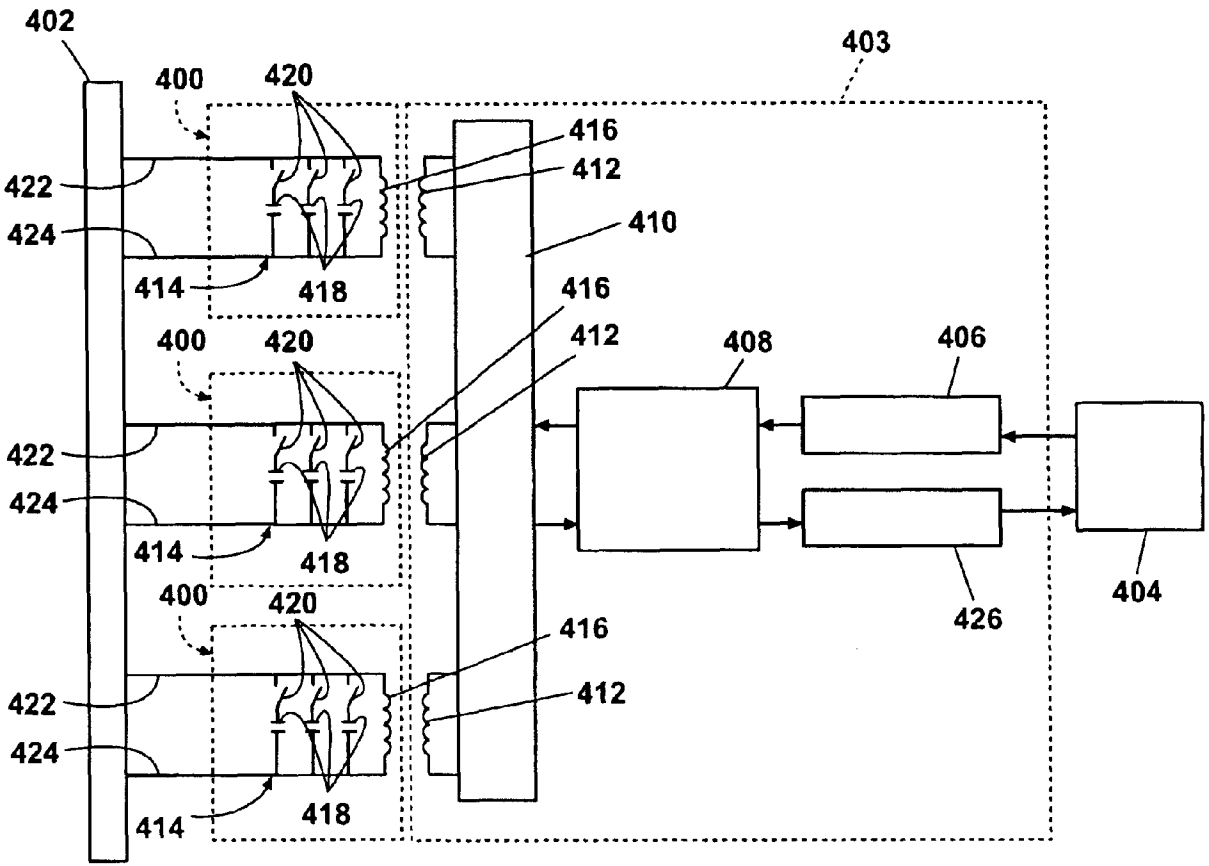
FIG. 19 is a schematic diagram showing another embodiment of a circuit for several shelves according to the invention.

FIGS. 18 and 19 illustrate yet another embodiment of the invention. Here, power is delivered to a removable shelf by way of a power bus in the refrigeration compartment, as disclosed above, but data is transmitted to and from the shelf by a path other than through the power bus. For example, it is within the scope of the invention to provide separate data lines paralleling the power bus. Thus, one might have the power bus disposed in one shelf ladder as shown in FIG. 1 and have the data lines disposed in the other shelf ladder. In this case, the power bus might appear as illustrated in FIG. 18, where a power bus 350 comprises a dielectric insulator 352 holding a continuous common conductor 354 and continuous power conductor 356 separated by a gap 358. Power connection to a shelf is not limited to discrete locations; rather, it can be obtained by a shelf circuit anywhere that the shelf connector is received in the gap 358. Identification and control of microenvironment zones can be accomplished by the circuit and/or software in association with the circuit.

An example of such a circuit, where data can be transmitted by induction, is shown in FIG. 19. A plurality of shelves 400, all connected to a power bus 402, cooperate with a circuit 403, which determines their resonance frequency variation and, on that basis, acts on a refrigeration control circuit 404. Each shelf is associated with a microenvironment zone, as described above, and a particular temperature in each zone can be obtained by selectively setting a temperature at a user interface on each shelf, whereupon the refrigerator control circuit will adjust in known manner the usual members for modifying the feed of refrigerated air into the zones. The description of the circuit on one shelf will apply equally to all.

The refrigeration control circuit 404 is connected to a control voltage generator or sweep generator 406, which in turn is connected to an oscillator 408, which operates with controlled voltage. This latter is connected to a switching element 410, which selects an appropriate inductor 412 for interrogating a determined shelf 400. The inductor 412 may be located in a wall of the refrigeration compartment.

Each shelf 400 has a resonant circuit 414 comprising an inductor 416 positioned at an edge of the shelf near the inductor 412, and several capacitors 418, each of which is serially connected to a switch 420. The switches and capacitors are connected parallel to the inductor 412, with power leads 422, 424 connected the common conductor and the power conductor, respectively, in the power bus 402. Each switch/capacitor combination represents a setting of a parameter (e.g. temperature) in the corresponding microenvironment zone. Any known user interface permits selection of a switch 420 on the shelf that will change the resonant frequency of the circuit 414.

Any change in the resonant frequency of the circuit 414 is picked up by the inductor 412 corresponding to that shelf, resulting in a corresponding change in the resonant frequency of the oscillator 408. A signal sensor 55 (for example a dip catcher) detects the change and sends an appropriate signal to the refrigeration control circuit 404, which, in turn, activates whatever is needed to achieve the selected parameter in the corresponding zone. If the refrigeration control circuit 404 includes a microprocessor, it will be able it identify and recognize which inductor has been the origin of the signal generated by the oscillator 408 where more than one shelf 400 is present and "active" within the refrigerator.

Other embodiments and modifications can be devised in the light of the present invention. For example, the shelf circuits can be of active type and comprise other remote connection means (for example radio-frequency, or other type) able to dialogue with the refrigerator control. Also, although the described examples refer to a shelf, the circuit can also be provided in or on a food-containing drawer in a refrigeration compartment. Yet further, the shelves can be sealed at one or more edges to better define an isolate a microenvironment zone. Separately removable enclosed compartments can be provided with connections according to the invention so that they can function as "plug-in" modules for a refrigerator. Moreover, although the circuits have been described as control circuits for altering atmospheric parameters in a microenvironment, it is contemplated that other uses of the power delivered to the shelves can be found. For example, lighting, sensors, scanners, detectors and the like can now be located and powered on a shelf in accord with the invention. The mounting means for the shelf is not limited to those described herein. It is within the scope of the invention for a shelf to be mounted in the refrigerator in any number of ways, including half shelves, partly cantilevered, non-powered shelf ladders, slides, glides, tracks, and rollers. Moreover, the term "shelf" is to be considered in its broadest sense as any device that will hold an item, including panels, drawers, and racks.

While the invention has been specifically described in connection with certain specific embodiments thereof, it is to be understood that this is by way of illustration and not of limitation, and the scope of the appended claims should be construed as broadly as the prior art will permit.

What is claimed is:

1. In a refrigerator comprising at least one compartment, selectively enclosable by a door, and containing at least one removable shelf and means for mounting the at least one removable shelf within the compartment, the improvement comprising:

a power bus disposed within the compartment, electrically connected to a power source, and a connector disposed on the removable shelf, whereby when the removable shelf is mounted within the compartment by the mounting means, the connector is connected to the power bus to deliver power to the removable shelf.

2. The improvement of claim 1 wherein the power bus comprises a ground conductor and a power conductor.

3. The improvement of claim 2 wherein the refrigerator has a control circuit for controlling at least one atmospheric parameter within the compartment, a shelf portion of the control circuit being mounted to the removable shelf, and a main portion of the control circuit being disposed remotely of the removable shelf, whereby the shelf circuit portion is powered by way of the power bus when the removable shelf is mounted within the compartment by the mounting means.

4. The improvement of claim 3 wherein the parameter controlled by the control circuit is temperature, and the shelf circuit portion has a user interface for adjusting the temperature from the removable shelf.

5. The improvement of claim 4 wherein actuation of the user interface generates a data signal in the shelf circuit portion and the data signal is transmitted to the main circuit portion.

6. The improvement of claim 5 wherein the data signal is transmitted to the main circuit portion by way of the power bus.

7. The improvement of claim 5 wherein the data signal is transmitted to the main circuit portion by way of induction.

8. The improvement of claim 5 wherein the data signal is transmitted to the main circuit portion by way of at least one data line.

9. The improvement of claim 3 wherein the power source is an isolated power supply in the main circuit portion.

10. The improvement of claim 9 wherein the power supply is 24 volts.

11. The improvement of claim 3 wherein the main circuit portion has a constant current source and voltage comparator coupled to a refrigerator control.

12. The improvement of claim 11 wherein the constant current source comprises a transistor.

13. The improvement of claim 11 wherein the constant current source and the voltage comparator are connected to the refrigerator control by at least one opto-isolator.

14. The improvement of claim 11 wherein the shelf circuit portion comprises a first user interface circuit having a first switch, at least one LED and a first resistor, the first switch and the at least one LED being connected in series and the first resistor and the at least one LED being connected in parallel.

15. The improvement of claim 14 wherein in a first mode, the first switch is actuated and the at least one LED is lit, indicating a first user setting.

16. The improvement of claim 14 comprising a second user interface circuit having a second switch, at least one second LED, and a second resistor, the second switch and the at least one second LED being connected in series, and the second resistor and the at least one second LED being connected in parallel, the second resistor having a significantly different resistance value than the first resistor, the first user interface circuit and the second user interface circuit being connected in parallel.

17. The improvement of claim 16 wherein one of the shelf circuit portion and main circuit portion has a capacitor connected in series across the power supply to the first and second resistors, and wherein selective actuation of the first or second switch will disengage the LED serially connected to the actuated switch, causing voltage to rise in the capacitor at a rate determined by the resistance value of the resistor serially connected to the actuated switch, which rate is timed by the voltage comparator and signaled to the refrigerator controller whereby the refrigerator controller can identify which switch is actuated.

18. The improvement of claim 11 wherein the shelf circuit portion comprises a touch sensor switch, a microprocessor, a voltage regulator, a capacitor, and at least two parameter circuits, each parameter circuit corresponding to a predetermined microenvironment within the compartment, and each parameter circuit comprising an LED, an LED resistor and an LED drive transistor, serially connected, the parameter circuits, microprocessor, touch sensor switch and capacitor being connected in parallel, and the main circuit portion has a microprocessor, whereby actuation of the touch sensor switch for a selected setting sends a signal corresponding to the selected setting to the main circuit portion microprocessor by way of the power bus.

19. The improvement of claim 18 wherein actuation of the touch sensor switch disengages the LEDs, and the signal comprises a time value corresponding to the time it takes voltage to recover to a predetermined value across the capacitor as measured by the voltage comparator, whereby the selected setting can be received and stored by the main circuit microprocessor.

20. The improvement of claim 19 wherein power to the shelf circuit portion is discontinued when the door is closed.

21. The improvement of claim 1 wherein the mounting means includes a shelf ladder and the removable shelf has a bracket that mounts to the shelf ladder to support at least a portion of the removable shelf by cantilever.

22. The improvement of claim 21 wherein the power bus is within the shelf ladder.

23. The improvement of claim 1 wherein a microenvironment zone is partially defined by the removable shelf, and the removable shelf comprises a user interface that controls at least one atmospheric parameter within the microenvironment zone.

24. The improvement of claim 23 wherein the refrigerator has a control circuit for controlling the at least one atmospheric parameter, the removable shelf comprising a shelf portion of the control circuit, and a main portion of the control circuit being disposed remotely of the removable shelf, whereby the shelf circuit portion is powered by way of the power bus when the removable shelf is mounted within the compartment by the mounting means.

25. The improvement of claim 23 wherein the power bus comprises a ground conductor and a power conductor, the power conductor comprising separate sections, one section for each microenvironment zone.

26. The improvement of claim 25 wherein the refrigerator comprises visual indicia to indicate the location of each microenvironment zone.

* * * * *